US006216366B1

(12) United States Patent
Donnadieu

(10) Patent No.: US 6,216,366 B1
(45) **Date of Patent: *Apr. 17, 2001**

(54) SOLE FOR A SPORT BOOT AND A SPORT BOOT HAVING SUCH A SOLE

(75) Inventor: Thierry Donnadieu, Annecy-le-Vieux (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/231,812

(22) Filed: Jan. 15, 1999

Related U.S. Application Data

(63) Continuation of application No. 08/788,826, filed on Jan. 27, 1997, now Pat. No. 5,899,006.

(30) Foreign Application Priority Data

Jan. 30, 1996 (JP) ..... 96 01251

(51) Int. Cl.[7] ..... A43B 3/26; A43B 5/04

(52) U.S. Cl. ..... 36/97; 36/31; 36/102; 36/117.2; 36/17.3; 36/115

(58) Field of Search ..... 36/31, 97, 102, 36/117.2, 117.3, 76 R, 108, 115; 12/146 B, 146 D

(56) References Cited

U.S. PATENT DOCUMENTS

| | | |
|---|---|---|
| 1,322,955 | 11/1919 | Roth . |
| 1,428,356 | 9/1922 | Brown . |
| 1,618,283 | 2/1927 | Hartwell . |
| 1,642,878 | 9/1927 | Hartwell . |
| 1,926,683 | 9/1933 | Miller . |
| 2,073,025 | 3/1937 | Prue . |
| 2,230,504 | 2/1941 | Rudner . |
| 2,317,918 | 4/1943 | Knipe . |
| 2,534,462 | 12/1950 | Lumbard . |
| 2,581,524 | 1/1952 | Ford . |
| 3,984,925 | 10/1976 | Famolare, Jr. . |
| 4,364,189 | 12/1982 | Bates . |
| 4,510,702 | 4/1985 | Ehrlich, Jr. . |
| 4,674,202 | 6/1987 | Bourque . |
| 4,924,606 | 5/1990 | Montgomery et al. . |
| 4,942,679 | 7/1990 | Brandon et al. . |
| 4,945,658 | 8/1990 | Provence . |
| 4,959,913 | 10/1990 | Provence et al. . |
| 5,899,006 * | 5/1999 | Donnadieu . |

FOREIGN PATENT DOCUMENTS

| | | |
|---|---|---|
| 1055400 | 4/1959 | (DE) . |
| 2901814 | 7/1980 | (DE) . |
| 1344087 | 10/1963 | (FR) . |
| 1593943 | 6/1970 | (FR) . |
| 2265294 | 10/1975 | (FR) . |
| 2478441 | 9/1981 | (FR) . |
| 465968 | 5/1937 | (GB) . |

* cited by examiner

*Primary Examiner*—Ted Kavanaugh
(74) *Attorney, Agent, or Firm*—Greenblum & Bernstein, P.L.C.

(57) ABSTRACT

A sole, especially for a sport boot, adapted to sports that require a foot movement or to gliding sports. The sole, especially an external sole, is constituted by a front part and a rear part. The rear part covers at least the base of the heel zone and is rigid and substantially non-flexible. Preferably, the rear part extends substantially up to the so-called metatarsophalangeal bending zone. The present invention also relates to a method for manufacturing a sole, especially a sole such as described hereinabove. In addition, it relates to a boot having a sole such as described hereinabove.

53 Claims, 2 Drawing Sheets

SOLE FOR A SPORT BOOT AND A SPORT BOOT HAVING SUCH A SOLE

CROSS-REFERENCE TO RELATED APPLICATIONS

This is a continuation of application Ser. No. 08/788,826, filed on Jan. 27, 1997, now U.S. Pat. No. 5,899,006 the disclosure of which is hereby incorporated by reference thereto in its entirety and the priority of which is claimed under 35 USC 120.

This application is also based upon French application No. 96.01251, filed on Jan. 30, 1996, the disclosure of which is hereby incorporated by reference thereto in its entirety and the priority of which is claimed under 35 USC 119.

BACKGROUND OF THE INVENTION

1. Field of the Invention

The present invention relates to a sole, especially an external sole for a boot intended for sports that require a movement of the foot and/or for gliding sports. The invention is also related to a method for manufacturing soles and a boot provided with such a sole, respectively, a boot provided with a sole obtained by such a manufacturing method.

2. Description of Background and Relevant Information

As mentioned hereinabove, the present invention relates to sports requiring movement of the foot, such as hiking, skating or conventional cross country skiing, alpine skiing, telemark skiing or snowshoeing. It also applies to gliding sports, such as ice skating, roller skating with or without in-line wheels, snowboarding or skateboarding.

The aforementioned sports have common requirements with respect to the boot, and especially to the sole, which requirements are, at the outset, incompatible.

In fact, all of these sports require a shifting of the user's center of gravity from the heel zone of the user's foot to the so-called metatarsophalangeal area of natural bending of the foot, and vice versa. This shifting serves to direct and/or propel the user's body, for example, by means of edge setting or equivalent operations, such as the movement impulse performed by striding with a roller skate, or of the cross country ski, whether with the conventional technique or the skating technique. This shifting of the center of gravity is accompanied by a transmission of forces in the heel zone, on the one hand, and in some cases, by a bending in the metatarsophalangeal bending zone, on the other hand.

This generates the requirement for a good transmission of the forces, without any losses by shock-absorption and deformation in the area comprised between at least the heel and the metatarsophalangeal zone and, consequently, a requirement for rigidity of the sole in this zone, often accompanied by a requirement for as natural a movement as possible and, therefore, for flexibility associated with the sole in the metatarsophalangeal zone.

Generally, the sport boot sole is formed in one piece. The thickness of the sole is generally varied in order to vary the rigidity thereof in the longitudinal direction.

It is obvious that the integration of the two different, and even incompatible, requirements in one element, i.e., the sole, can only be performed to the detriment of one of these requirements, i.e., the transmission of the forces coming from the leg in the zone comprised between the heel and metatarsophalangeal zone and/or the flexibility in the latter zone.

The resulting problem is that this construction of the sole cannot meet all of the requirements at the same time, and it usually represents an unsatisfactory compromise between rigidity and flexibility.

Another problem concerns the manufacture of soles of the aforementioned type in one piece. These soles entail high manufacturing costs, because it is necessary to provide soles, of specific and various lengths, for all the desired sizes. This results in a necessity of manufacturing and storing a large number of different soles, or of cutting the edges of a sole to manufacture a smaller size. This latter technique, which is only used for the wear soles is a waste of material and, in reality, does not lower the production costs.

In the document No. U.S. Pat. No. 2,581,524, it is proposed to manufacture a midsale in two parts. However, this sole is adapted to a boot for spare-time activities and, therefore, the rear part remains flexible, although it has a higher rigidity with respect to the front part. The flexibility and a certain shock absorption in the rear portion are obtained by making it out of materials such as cork, sawdust or latex. The known sole of this document is therefore not capable of transmitting forces intended for edge setting, for example, and does not provide a satisfactory solution to the problems described hereinabove.

SUMMARY OF THE INVENTION

An object of the present invention is to propose an improved sole which makes it possible to conciliate the aforementioned conflicting requirements, and especially an improved transmission of the forces and a satisfactory flexibility of the sole while maintaining moderate production costs.

Another object of the invention is to propose a method for manufacturing a sole and a boot provided with such a sole, respectively, a boot provided with a sole obtained using such a method.

The central idea of the present invention is to provide a two-part sole, especially for a sport boot, including one front part and one rear part adjacent to the front part.

According to a first aspect of the present invention, the rear part is rigid and substantially non-flexible. This characteristic enables an efficient transmission of the forces coming from the user's leg and adapted to the direction and/or propulsion of the user's body, especially by allowing an efficient edge setting, or for cooperate with a guiding system of the ridge-type in cross country ski.

The rigid rear portion preferably extends in the zone comprised between the heel and the metatarsophalangeal zone.

According to a second aspect of the present invention, the two parts constituting the sole overlap in and/or behind the metatarsophalangeal zone in a junction zone with adjustable length depending on the size. The variation in the overlapping length allows for the manufacture of soles of various sizes on the base of the identical rear and front portions, respectively, which considerably reduces the production and storage costs through the diminution of the number of various parts to be manufactured.

BRIEF DESCRIPTION OF DRAWINGS

In any event, the invention will be better understood, and other characteristics thereof will become apparent along the description that follows, with reference to the annexed schematic drawing representing, by way of non-limiting example, a plurality of embodiments, and in which.

DETAILED DESCRIPTION OF THE INVENTION

Figure 1:
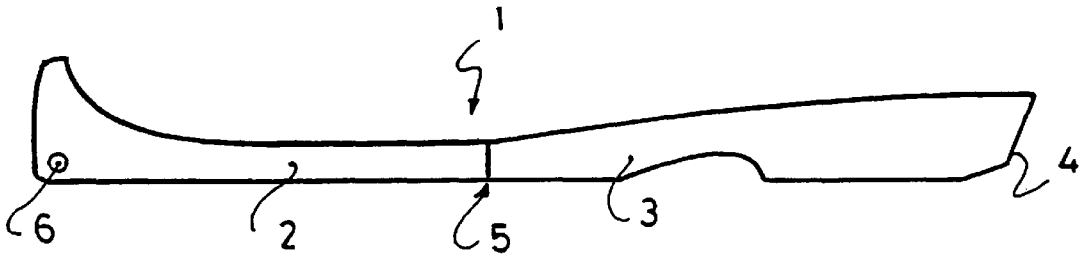
FIG. 1 is a side view of a sole of a first embodiment of the present invention.

In FIG. 1, an external sole 1 adapted to a cross country ski boot is schematically shown. However, the present invention also applies to all sports that require a transmission of the forces coming from the user's leg and are adapted to the direction and/or propulsion of the user's body, especially for an operation commonly referred to as edge setting. Examples of such forms of sport are snowshoeing, cross country skiing, telemark skiing, hiking, snowboarding, ice skating or roller skating. For simplification, the following description is made in reference to an external sole adapted to a cross country ski boot.

The sole 1 shown is constituted of only two parts 2, 3, that are adjacent to one another. The advantage of the construction of the sole 1 in two parts 2, 3 is that each part 2, 3 can be designed optimally according to the requirements to be met and with the ability to standardize the production, respectively, as will be seen hereinafter. The freedom of design adapted the particular requirements for each part 2, 3, independently of one another, manifests itself, for example, through the possibility of a choice of various materials for the front part 2 and the rear part 3.

Preferably, the rear part 3 extends in a zone comprised between the heel 4 and the metatarsophalangeal natural bending zone 5.

As is shown in FIG. 1, the front part 2 of the sole 1 can be provided with a coupling element 6, such as a transverse axle, adapted for the coupling to a gliding support such as a cross country ski, not shown in the figure. This gliding support can, for example, be any ski, an ice or roller skate, a snowboard or a snowshoe.

The rear part 3 is preferably rigid and substantially non-flexible, which prevents losses by shock absorption and local deformations, and enables a better transmission of the forces. The rear part 3 is made out of any material which guarantees a quasi flexibility of this part, and especially a plastic material with appropriate rigidity, possibly reinforced by glass or carbon fibers, or metallic materials. This rear part preferably has a flexural modulus of elasticity comprised between 260 MPa (Mega Pascal) and 200 GPA (Giga Pascal).

Conversely, the front part 2 is preferably flexible, so as to enable as natural a foot movement as possible. This characteristic provides advantages for use in sports such as cross country skiing and hiking which require a movement of the metatarsophalangeal zone of the foot.

Therefore, this front part 2 is preferably made of a plastic material having an appropriate flexibility for such a foot movement.

Figure 2A:
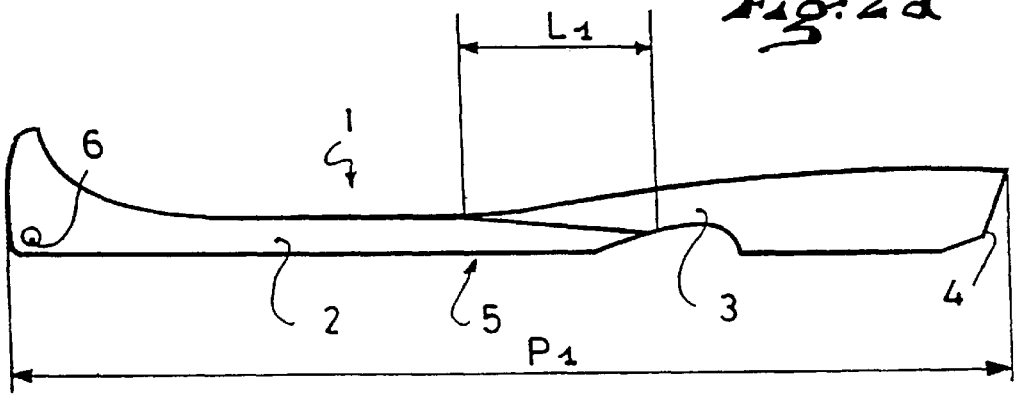
FIGS. 2*a*, 2*b*, are side views a sole according to another embodiment of the present invention.
Figure 2B:
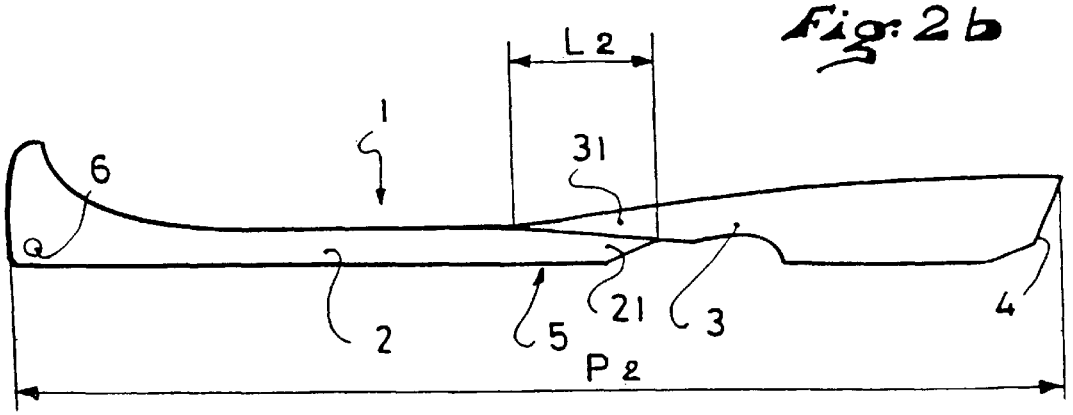
Figure 4:
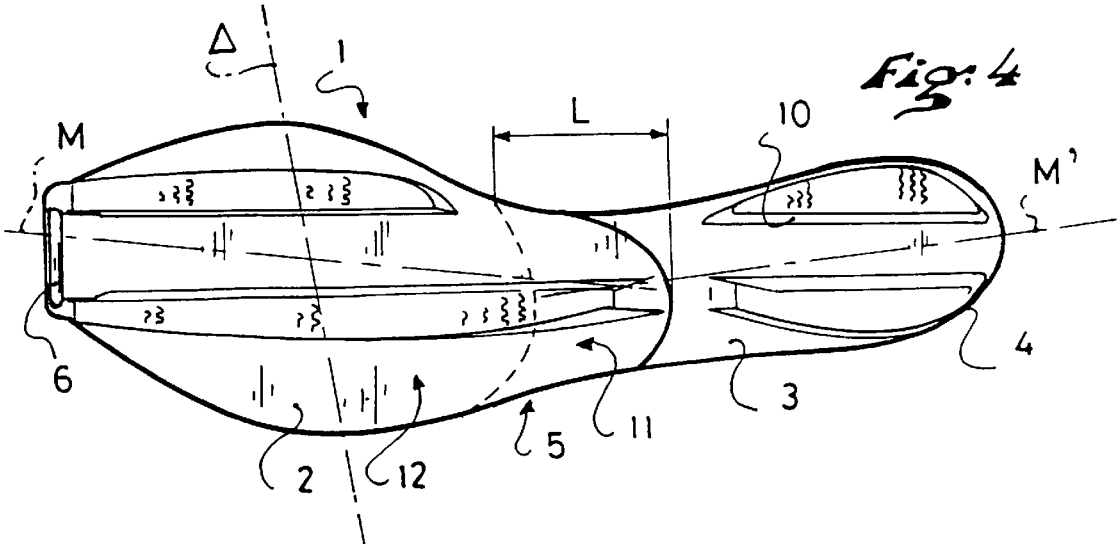
FIG. 4 is a bottom view of a sole according to the present invention.

FIGS. 2*a*, 2*b*, and 4 illustrate another embodiment of the present invention, and in particular the method for manufacturing a sole according to the present invention.

As shown in FIGS. 2*a*, 2*b*, and 4, the front part 2 and the rear part 3 of the sole 1 overlap on a junction zone 5 with a predetermined length "L", this length being adjustable according to the size, as will be explained subsequently. The junction or overlapping zone preferably extends in and/or behind the metatarsophalangeal bending zone.

The extreme front limit of the overlapping zone 5 is constituted by the metatarsophalangeal journal axis "Δ". For reasons related to progressiveness and comfort, and to ensure a better foot movement without fracture, the overlapping zone 5 will preferably have a rigidity comprised between those of the rear part 3 and of the front part 2, or even a rigidity that decreases progressively from its zone of junction with the rear portion up to its zone of junction with the front part, for a perfect transition between these two extreme rigidities.

The method for manufacturing a sole according to the present invention will now be described with reference to FIGS. 2*a* and 2*b*.

In a first step, a plurality of front parts 2 and a plurality of rear parts 3 are provided, which are respectively identical and have forms that correspond substantially to the front and rear parts, respectively, of a human foot. However, the front 2 and/or rear 3 parts could also have a form that requires a cutting out for finishing the sole, namely, an essentially rectangular form.

The front parts 2 and rear parts 3 can be made of different materials. A choice of different materials further facilitates the provision of different rigidities, if desired, for the front parts 2 with respect to the rear parts 3.

In a second step, the front part 2 is aligned with respect to the rear part 3 in an overlapping manner. To better correspond to the natural form of a human foot, as illustrated in FIG. 4, the two parts 2, 3, can be aligned such that their median longitudinal axes M-M', respectively, form an angle corresponding to an angle of the natural anatomy of the foot, instead of being merged.

In a third step, the overlapping length "L1, L2" (see FIGS. 2*a*, 2*b*) of the two parts 2, 3, respectively, is determined, such that the effective length "P1, P2" (see FIGS. 2*a*, 2*b*), respectively, of the finished sole corresponds to the desired size of the sole, and therefore of the boot which is going to be provided with such a sole. It must be noted that the difference between two consecutive sizes generally is approximately 7 mm. Thus, as readily illustrated by the comparison of FIGS. 2*a* and 2*b*, an overlapping over a greater length "L1" makes it possible to obtain a sole having a smaller total length "P1", and vice versa.

Preferably, a combination of certain identical front parts 2 and identical rear parts 3 is used for manufacturing soles 1 whose length "P" corresponds to a range of two to three sizes. This results in a reduction of one-half or one-third, respectively, of the stock of different parts 2, 3. Preferably, the variation in the overlapping length "L" is therefore equal to 14 or 21 mm, respectively.

It must be noted that by varying the overlapping length "L", it is possible, due to the present invention, to manufacture soles according to a system of continuous sizes, i.e., whose gradation between sizes is as fine as desired, on the base of a stock of parts 2, 3 constituting a rough gradation system.

Preferably, it is the front part 2 that overlaps the rear part 3. This arrangement particularly has advantages regarding the durability of the attachment of the front part 2 to the rear part 3, especially when the front part 2 has a lower rigidity than that of the rear part 3. As shown in FIGS. 2*a* and 2*b*, the front end 31 of the rear part 3 has a bevelled decreasing section in the longitudinal direction, so does the rear portion 21 of the front part 2. This allows for an overlapping of the two parts without excessive thickness in the transmission zone, on the one hand, and makes it possible to modulate the rigidity of the transmission zone in the longitudinal zone.

In a fourth step, the front part 2 is affixedly attached with respect to the rear part 3. The preferred attachment means are adhesion and riveting. However, all attachment means that enable a solid binding, even under flexional or torsional biases, and under variable temperatures, are adapted.

As a result from the manufacturing method according to the present invention, a sole of desired size is obtained in the entire range of possible sizes on the base of parts 2, 3, which are available in a more limited number of sizes.

Inasmuch as the invention is preferably directed to sports boots, a rearward zone of the rear part 3 provides for a relatively low heel 4. More particularly, as can be seen in the drawings, a common plane, substantially horizontal, extends substantially continuously from a rear end of the rear part 3 to a front end of the front part 2 of the sole.

Figure 3:
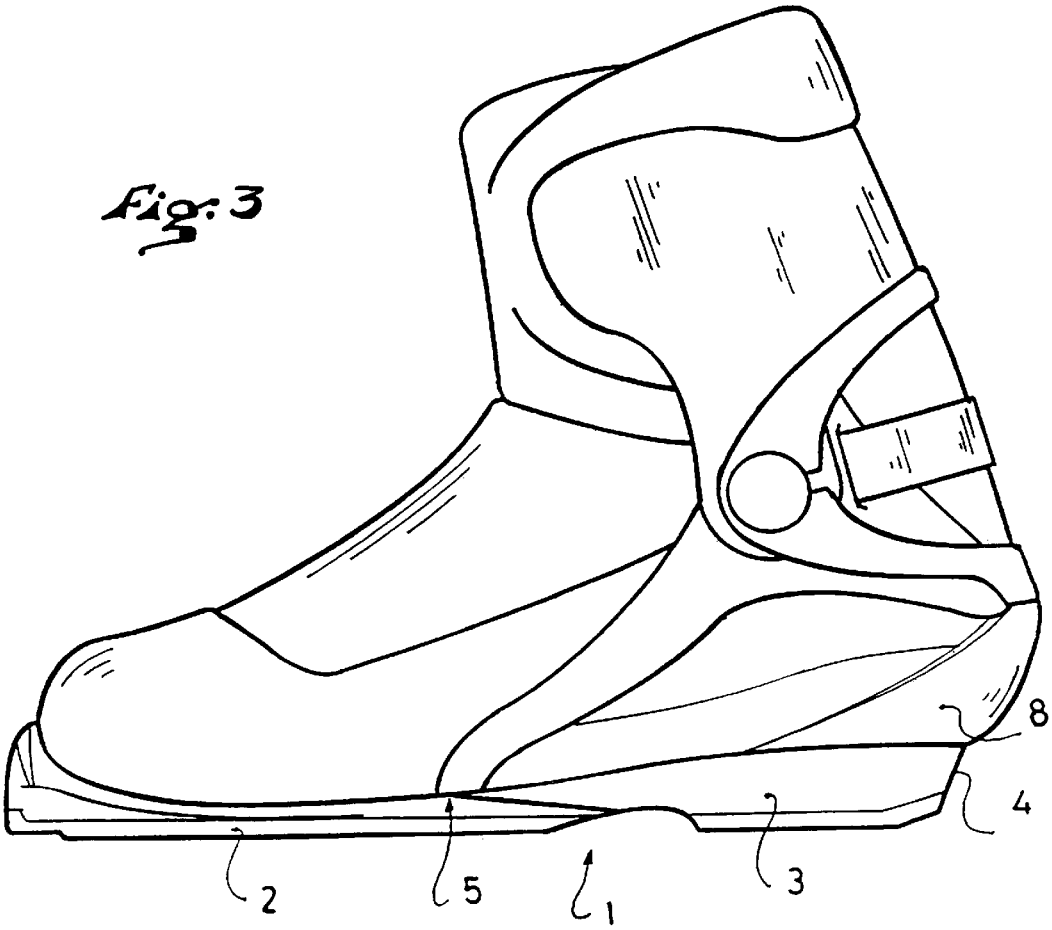
FIG. 3 is a lateral view of a boot integrating a sole according to the present invention.

Another embodiment of the present invention is shown in FIG. 3.

According to the embodiment shown in FIG. 3, the rear part 3 of the sole 1 forms a monoblock assembly with a rear stiffener 8 of the boot, i.e., the rear part and the rear stiffener are unitary, or made as one piece. The stiffener 8 surrounds the heel of the foot in the manner of a shell. Preferably, the stiffener 8 extends from the heel zone 4 up to the metatarsophalangeal natural bending zone 5. The effect of the retention, in the manner of a shell, of the heel of the foot by the monoblock assembly formed by the rear part 3 of the sole 1 and the stiffener 8 is clearly improved when the stiffener 8 is substantially rigid, with a rigidity similar to that of the sole. Preferably, the rigidity of the stiffener 8 is less than the rigidity of the rear part 3 of the sole 1 which, as mentioned above, is substantially non-flexible.

The choice of rigidities for the stiffener 8 and the rear part 3 of the sole 1, respectively, can be made optimally by forming the stiffener 8 and the rear part 3 of the sole 1 out of a same material, or of different materials, while maintaining the monoblock assembly.

The preferred materials for the stiffener 8 are leather or plastic materials that are optionally reinforced by metallic inserts or glass or carbon fibers.

FIG. 4 is a bottom view showing a sole according to the present invention. As shown in the Figure, and to better correspond to the natural shape of a human foot, the two parts 2, 3, are aligned such that their median longitudinal axes M–M' form an angle instead of being merged.

According to the embodiment shown in FIG. 4, the front part 2 of the sole 1 includes two zones 11, 12, that are preferably formed of different materials. The zone 11 constitutes the overlapping zone "L" of the front part 2 of the sole 1. As indicated previously, this overlapping zone 11 can extend forwardly up to the metatarsophalangeal journal axis "Δ". Likewise, this overlapping zone 11 preferably has a greater rigidity than that of the front zone 12, and which is comprised between the rigidity of the front part 2 and the rigidity of the rear part 3 of the sole 1. This construction allows for an improved attachment of the front part 2 to the rear part 3 by decreasing the differences in rigidity between two adjacent parts in the overlapping zone "L".

The heel zone 4 of the rear part 3 of the sole 1 is, particularly for a cross country ski boot, provided with a guide groove 10 capable of cooperating with a ridge-shaped device provided on a gliding support, for example, a cross country ski. Such a guide groove also extends in the front part 2 of the sole. It must be noted that the rear part 3 of the sole can be provided, depending on the desired use, with any system cooperating with a gliding support and/or a shaped element for improved retention and edge setting of the sole 1 on the ground.

The front part 2 of the sole 1 is, as previously described, provided with a hooking element 6 for a journalled binding of the front of the boot provided with the sole 1 on a cross country ski. It must be noted that the front part 2 can also be provided with any other binding system cooperating with a gliding or walking support, such as a snowboard or a snowshoe, for example.

Of course, the above description has been made by way of a non-limiting example. It is obvious to one skilled in the art that numerous modifications can be made without leaving the scope of the invention such as defined in the claims. For example, a sole according to the present invention can also include more than two constituent parts, for example, by dividing the rear part and/or front part into a plurality of sub-parts.

What is claimed is:

1. A sole for a sport boot, said sole comprising:

a front part;

a rear part, distinct from said front part, said rear part being connected to and extending rearwardly from and beyond said front part and including a heel zone, a plane extending substantially continuously through the sole from a rear end of said rear part to a front end of said front part;

said front part and said rear part are made from different materials, said rear part being rigid and substantially non-flexible and having a flexural modulus of elasticity between 260 MPa and 200 GPa;

said front part being less rigid than said rear part.

2. A sole for a sport boot according to claim 1, wherein:

said front part is flexible.

3. A sole for a sport boot according to claim 1, wherein:

said front part is provided with at least one coupling element, distinct from and secured to said front part, for attachment to a gliding support.

4. A sole for a sport boot according to claim 1, wherein:

said front part is provided with at least one coupling element, distinct from and secured to said front part, for attachment to a cross-country ski.

5. A sole for a sport boot according to claim 1, wherein:

said front part includes a median longitudinal axis, said rear part includes a median longitudinal axis;

said median longitudinal axes of said front and rear parts are not coextensive and intersect at an angle.

6. A sole for a sport boot according to claim 1, in combination with:

a stiffener extending above said sole and adapted to extend behind a heel inserted within the sport boot, said stiffener being unitary with said sole.

7. A sole for a sport boot according to claim 6, wherein:

said rear part and said stiffener are made of different materials.

8. A sole for a sport boot according to claim 1, wherein:

said rear part and said stiffener have different rigidities.

9. A sole for a sport boot according to claim 8, wherein:

said rigidity of said rear part is greater than the rigidity of said stiffener.

10. A sole for a sport boot according to claim 9, wherein:

said rear part and said stiffener are made of different materials.

11. A sole for a sport boot according to claim 8, wherein:

said rear part and said stiffener are made of different materials.

12. A sole for a sport boot according to claim 1, wherein:

said sole is adapted to be an external sole for the sport boot.

13. A sole for a sport boot according to claim 1, wherein:

said rear part extends to a rearwardmost end of the sole.

14. A sole for a sport boot according to claim 1, wherein:

said front part and said rear part are non-unitary.

15. A sole for a sport boot according to claim 1, wherein:

said front part and said rear part are connected together with an adhesive.

16. A sole for a sport boot according to claim 1, wherein:

said front and rear parts are connected together at an overlapping zone, said overlapping zone extending longitudinally over a distance of at least twice a boot size.

17. A sole for a sport boot according to claim 1, wherein:

said front and rear parts are connected together at an overlapping zone, said overlapping zone extending longitudinally over a distance of no greater than three times a boot size.

18. A sole for a sport boot according to claim 17 wherein:

said distance of said overlapping zone extends no greater than 21 mm.

19. A sport boot comprising:

a sole comprising:

a front part;

a rear part, distinct from said front part, said rear part being connected to and extending rearwardly from and beyond said front part and including a heel zone, a plane extending substantially continuously through the sole from a rear end of said rear part to a front end of said front part;

said front part and said rear part are made from different materials, said rear part being rigid and substantially non-flexible and having a flexural modulus of elasticity between 260 MPa and 200 GPa;

said front part being less rigid than said rear part.

20. A sole for a sport boot according to claim 19, wherein:

said rear part extends to a rearwardmost end of the sole.

21. A sport boot according to claim 19, further comprising:

a stiffener extending above said sole and adapted to extend behind a heel inserted within the sport boot, said stiffener being unitary with said sole.

22. A sport boot according to claim 19, wherein:

said front part and said rear part are non-unitary.

23. A sport boot according to claim 19, wherein:

said front part and said rear part are connected together with an adhesive.

24. A sport boot according to claim 19, wherein:

said front and rear parts are connected together at an overlapping zone, said overlapping zone extending longitudinally over a distance of at least twice a boot size.

25. A sport boot according to claim 19, wherein:

said front and rear parts are connected together at an overlapping zone, said overlapping zone extending longitudinally over a distance of no greater than three times a boot size.

26. A sport boot according to claim 25, wherein:

said distance of said overlapping zone extends no greater than 21 mm.

27. A sport boot comprising:

an external sole comprising:

a front part;

a rear part extending rearwardly from and beyond said front part and including a heel zone, said rear part comprising a rigid and substantially non-flexible plastic material, said front part comprising a plastic material having a rigidity less than a rigidity of said non-flexible plastic material of said rear part;

said rear part being connected to said front part substantially at a metatarsophalangeal bending zone, whereby said front and rear parts overlap and form an overlapping zone at least partially in a predetermined zone, said predetermined zone comprising one of: (1) said metatarsophalangeal bending zone and (2) a zone rearward of said metatarsophalangeal bending zone; and a plane extending substantially continuously through the sole from a rear end of said rear part to a front end of said front part.

28. A sport boot according to claim 27, wherein:

said rear part has a flexural modulus of elasticity between 260 MPa and 200 GPa.

29. A sport boot according to claim 27, wherein:

said rear part extends to a rearwardmost end of the sole.

30. A sport boot according to claim 27, wherein:

said front part and said rear part are made from different materials.

31. A sport boot according to claim 27, wherein:

said front part and said rear part are non-unitary.

32. A sport boot according to claim 27, wherein:

said front part and said rear part are connected together with an adhesive.

33. A sport boot according to claim 27, wherein:

said front part of said sole extends forwardly vertically beneath a front end of the boot.

34. A sport boot according to claim 27, wherein:

said front part of said sole is a unitary member and said rear part of said sole is a unitary member, said front part extending forwardly from said overlapping zone to a front end of the boot.

35. A sport boot according to claim 27, wherein:

said overlapping zone extends longitudinally over a distance of at least twice a boot size.

36. A sport boot according to claim 27, wherein:

said overlapping zone extends longitudinally over a distance of no more than three times a boot size.

37. A sport boot according to claim 36, wherein:

said distance of said overlapping zone extends no greater than 21 mm.

38. A sport boot according to claim 27, wherein:

said overlapping zone has a rigidity less than the rigidity of said rear part and greater than the rigidity of said front part.

39. A sport boot according to claim 27, wherein:

said front part is flexible.

40. A sport boot according to claim 27, wherein:

in said overlapping zone, said front part extends beneath said rear part.

41. A sport boot according to claim 29, wherein:

said front part is provided with at least one coupling element, distinct from and secured to said front part, for attachment to a gliding support.

42. A sport boot according to claim 29, wherein:

said front part is provided with at least one coupling element, distinct from and secured to said front part, for attachment to a cross-country ski.

43. A sport boot according to claim 27, wherein:

said front part includes a median longitudinal axis, said rear part includes a median longitudinal axis;

said median longitudinal axes of said front and rear parts are not coextensive and intersect at an angle.

44. A sport boot according to claim 27, further comprising:

a stiffener extending above said sole and adapted to extend behind a heel inserted within the sport boot, said stiffener being unitary with said sole.

45. A sole for a sport boot according to claim 44, wherein:

said rear part and said stiffener are made of different materials.

46. A sole for a sport boot according to claim 44, wherein:

said rear part and said stiffener have different rigidities.

47. A sole for a sport boot according to claim 46, wherein:

said rear part and said stiffener are made of different materials.

48. A sole for a sport boot according to claim 46, wherein:

said rigidity of said rear part is greater than the rigidity of said stiffener.

49. A sole for a sport boot according to claim 48, wherein:

said rear part and said stiffener are made of different materials.

50. A plurality of soles for use in a plurality of respective sport boots, wherein:

each of said plurality of soles comprises:

a front part comprising a first material;

a rear part comprising a second material, said rear part extending rearwardly from said front part and including a heel zone, said second material of said rear part being rigid and substantially non-flexible, said first material of said front part having a rigidity less than a rigidity of said second material of said rear part;

said rear part being connected to said front part substantially at a metatarsophalangeal bending zone and said front and rear parts overlap, and forming an overlapping zone, at least partially in a predetermined zone, said predetermined zone comprising one of: (1) said metatarsophalangeal bending zone and (2) a zone rearward of said metatarsophalangeal bending zone;

said front parts of at least two of said plurality of soles having identical lengths and said rear parts of said at least two of said plurality of soles having identical lengths;

said at least two of said plurality of soles having different lengths by virtue of said overlapping zones of said at least two of said plurality of soles having different lengths.

51. A plurality of soles according to claim 50, wherein:

each of said plurality of soles further include a stiffener extending above said sole and adapted to extend behind a heel inserted within the sport boot, said stiffener being unitary with said sole.

52. A plurality of soles according to claim 50, wherein:

said rear part of each of said soles extends to a rearwardmost end of the sole.

53. A plurality of soles according to claim 50, wherein:

said second material of said rear part of each of said soles has a flexural modulus of elasticity between 260 MPa and 200 GPa.

* * * * *